US005328569A

United States Patent [19]

Cronin

[11] Patent Number: 5,328,569

[45] Date of Patent: Jul. 12, 1994

[54] CURVED SUCTION BOX APPARATUS IN A PAPERMAKING MACHINE PRESS SECTION

[75] Inventor: Dennis C. Cronin, Rockton, Ill.

[73] Assignee: Beloit Technologies, Inc., Wilmington, Del.

[21] Appl. No.: 905,256

[22] Filed: Jun. 26, 1992

[51] Int. Cl.[5] ..... D21F 1/52

[52] U.S. Cl. ..... 162/306; 162/358.1; 162/363; 162/374

[58] Field of Search ..... 162/306, 301, 352, 374, 162/363, 358.1

[56] References Cited

U.S. PATENT DOCUMENTS

| | | | |
|---|---|---|---|
| 3,441,476 | 4/1969 | Schiel | 162/306 |
| 3,537,955 | 11/1970 | Huerta et al. | 162/306 |
| 3,846,233 | 11/1974 | Kankaanapaa | 162/301 |
| 3,855,057 | 12/1974 | Hill | 162/306 |
| 3,992,254 | 11/1976 | Lehtinen | 162/300 |
| 4,113,557 | 9/1978 | Kankaanpaa | 162/306 |
| 4,236,962 | 12/1980 | Kankaanpaa | 162/306 |
| 4,484,981 | 11/1984 | Fuchs | 162/352 |
| 4,523,978 | 6/1985 | Pullinen | 162/301 |
| 4,734,164 | 3/1988 | Irwin | 162/352 |
| 4,880,500 | 11/1989 | Eldridge | 162/306 |
| 5,034,100 | 7/1991 | Sides | 162/306 |
| 5,074,966 | 12/1991 | Koiruranta | 162/301 |
| 5,084,138 | 1/1992 | Ewald | 162/301 |

FOREIGN PATENT DOCUMENTS

| | | | |
|---|---|---|---|
| 0253508 | 1/1988 | European Pat. Off. . | |
| 201776 | 11/1889 | France | 162/306 |
| 810707 | 3/1959 | United Kingdom | 162/306 |

*Primary Examiner*—Karen M. Hastings

*Attorney, Agent, or Firm*—Dirk J. Veneman; Raymond W. Campbell; David J. Archer

[57] ABSTRACT

A curved suction box apparatus is disclosed for guiding a web towards a nip of a nip press. The apparatus includes an initial shoe which is disposed upstream relative to the nip, the shoe defining a convex surface for guiding the web. A box is disposed downstream relative to the initial shoe for guiding the web from the initial shoe. The box is connected to a partial vacuum.

14 Claims, 4 Drawing Sheets

CURVED SUCTION BOX APPARATUS IN A PAPERMAKING MACHINE PRESS SECTION

BACKGROUND OF THE INVENTION

1. Field of the Invention

The present invention relates to a curved suction box apparatus for guiding a web towards a nip defined by a pair of cooperating rolls or a nip of an extended nip press.

More particularly, the present invention relates to a curved suction box apparatus which avoids the need for suction rolls or the like.

2. Information Disclosure Statement

In a press section of a papermaking machine, a suction pick-up roll is usually provided for transferring a formed web from a fourdrinier wire onto a press felt such that the press felt guides the formed web towards a downstream pressing nip.

Also, when the formed web is supported beneath the aforementioned press felt for guidance towards a nip press, the web is preferably subjected to a flow of steam prior to passage of the formed web through the nip.

More particularly, the steam is usually applied directly to the surface of the web by means of a steam box or the like. A vacuum box is disposed on the opposite side of the web for extracting excess steam from the web.

More specifically, when heat is applied to a formed web supported on a press felt such as by the application thereto of steam, the viscosity and surface tension of the water within the web is reduced and the fibers within the web are softened and are hence easier to compact, due to the increased temperature thereof. Such decreased viscosity and fiber softening facilitates removal of additional quantities of water from the web while strengthening the web during subsequent pressing of the web through the nip press.

However, the provision of a suction pick-up roll or the provision of one or more vacuum rolls in the vicinity of the steam box involves considerable expense during manufacture thereof. For example, a suction roll may require 600 man hours for drilling the roll shell thereof. Also, such roll requires the provision of relatively complex internal sealing glands and the like. Therefore, it is not unusual for a suction roll to cost $1 million or more.

The present invention overcomes the aforementioned costly procedures by the provision of an integrated suction box which includes an initial shoe having a convex surface and a further shoe defining a further convex surface with a suction box disposed between the respective shoes.

Alternatively, the present invention includes an arrangement including a suction box and only one shoe.

The aforementioned curved suction box apparatus enables removal of the web from a fourdrinier forming wire onto a press felt or, alternatively, enables guidance of a web while such web is subjected to saturation with steam.

Therefore, it is a primary objective of the present invention to provide a curved suction box apparatus which overcomes the aforementioned inadequacies of the prior art proposals and which makes a considerable contribution to the art of guiding a web in a press section.

Another object of the present invention is the provision of a curved suction box apparatus which includes an initial shoe which defines a convex surface for guiding the web, a box disposed downstream relative to the initial shoe and a further shoe which defines a further convex surface for guiding the web from the box towards a nip press.

Another object of the present invention is the provision of a curved suction box apparatus in which the initial and further shoe are of ceramic material in order to reduce wear thereof.

Another object of the present invention is the provision of a curved suction box apparatus in which the convex and further convex surfaces of the shoes define a plurality of perforations connected to a source of partial vacuum for drawing the web towards the respective convex surfaces.

A further object of the present invention is the provision of a curved suction box apparatus in which the box includes a first and a second compartment so that the rate of removal of steam from the web can be regulated in a machine direction.

Another object of the present invention is the provision of a curved suction box apparatus which includes a plurality of showers for supplying lubricating water to the respective surfaces of the curved suction box apparatus for reducing frictional wear between such surfaces and the web or a press felt supporting the web.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a curved suction box apparatus for guiding a web towards a nip of a nip press. More particularly, the curved suction box apparatus includes an initial shoe means disposed upstream relative to the nip, the shoe means defining a convex surface for guiding the web.

A box means is disposed downstream relative to the initial shoe means for guiding the web from the initial shoe means. The box means is connected to a partial vacuum means.

A further shoe means is disposed downstream relative to the box means, such further shoe means defining a further convex surface for guiding the web from the box means towards the nip.

More specifically, the initial shoe means is of ceramic material and defines a plurality of perforations which extend from the convex surface to a variable source of partial vacuum such that the web guided by the convex surface is drawn towards the convex surface.

More particularly, the initial shoe means includes a solid shoe which has an initial curved surface for guiding the web and a further shoe disposed downstream relative to the solid shoe. The further shoe has a further curved surface which defines a plurality of perforations extending from the further curved surface to a variable source of partial vacuum such that the web is drawn towards the further curved surface.

The apparatus also includes a frame work which defines a dove-tail shaped extension.

The solid shoe defines a cross-machine directional undercut groove which cooperates with the dove-tail shaped extension for removably securing the solid shoe to the frame work.

The box means includes a perforate surface which is connected to a partial vacuum means such that the web is drawn towards the perforate surface during movement of the web past the perforate surface.

More specifically, the box means includes a first compartment which is disposed adjacent to the initial shoe means. The first compartment is connected to a first source of partial vacuum of the partial vacuum means for drawing the web towards the perforate surface.

A second compartment is disposed downstream relative to the first compartment. The second compartment is connected to a second source of partial vacuum of the partial vacuum means for assisting in drawing the web towards the perforate surface.

The perforate surface also includes an upstream perforate closure which cooperates with the first compartment, and a downstream perforate closure which cooperates with the second compartment. The arrangement is such that application of a differential vacuum level to the upstream closure relative to the downstream closure is permitted.

In one embodiment of the present invention, the perforate surface is flat, and in an alternative embodiment of the present invention, the perforate surface is convex.

In a preferred embodiment of the present invention, the further shoe means is of ceramic material and defines a plurality of channels which extend from the further convex surface to a partial vacuum source for guiding the web towards the nip.

Additionally, the apparatus includes a first shower for supplying lubricating water to the web between the further shoe means and the box means.

The apparatus also includes a second shower for supplying lubricating water to the web between the upstream and the downstream closures, and a third shower for supplying lubricating water to the web between the box means and the initial shoe means.

Also, a shower means is provided for supplying lubricating water to the web between the solid shoe and the further shoe.

The apparatus also includes a flood shower which is disposed upstream relative to the initial shoe means for continuously supplying lubricating water for lubricating and cooling the apparatus, such flood shower being disposed between the initial shoe means and the web.

The present invention also includes an arrangement in which steam application means is disposed adjacent to the box means such that the web is disposed between the application means and the box means. The arrangement is such that upon application of steam to the web by the steam application means, such steam reduces the viscosity of water within the web to assist removal of such water during subsequent pressing in the extended nip press.

Moreover, excess steam is drawn through the web and is extracted through the box means.

More specifically, when treating heavier basis weight sheets, the vacuum provides greater penetration of the steam into the sheet. The objective is not for the steam to really go through the sheet, as such would provide a rather poor heat transfer. The object is rather to have as much steam as possible penetrate as deep into the sheet as possible and to condense therein, thereby giving up latent heat to the web.

Many modifications and variations of the present invention will be readily apparent to those skilled in the art by a consideration of the detailed description, taken in conjunction with the annexed drawings. However, such modifications and variations fall within the spirit and scope of the present invention as defined by the appended claims.

Included amongst such modifications would be the provision of an inverted extended nip press in which the shoe is disposed above the backing roll.

Additionally, the combined shoe and suction box of the present invention may be located at the exit of the press nip, thereby facilitating guidance of the web away from the nip.

The present invention particularly overcomes the problem of sheet blowing. Sheet blowing is a phenomena that occurs particularly at high speed, when a web approaches a pair of counter-rotating press rolls. Air currents generated by movement of the web tend to form a high pressure zone at the converging nip which tends to blow the sheet from the supporting felt. The aforementioned problem of sheet blowing presents itself whenever the web is supported on a single felt entering either a conventional or an extended nip press.

In the prior art arrangements, anti-blow rolls were provided with suction means for drawing such high pressure air from the converging nip. However, such anti-blow rolls often had a diameter greater than the diameter of the backing roll of the press nip. Therefore, it was impossible to position such anti-blow rolls close to the high pressure converging nip location.

The present invention overcomes the aforementioned problem, and enables the positioning of the suction box very close to the converging nip.

An additional advantage provided by the suction box of the present invention is that the suction box runs considerably quieter than the equivalent anti-blow suction roll used in prior art arrangements.

BRIEF DESCRIPTION OF THE DRAWINGS

Similar reference characters refer to similar parts throughout the various embodiments of the present invention.

DETAILED DESCRIPTION OF THE DRAWINGS

Figure 1:
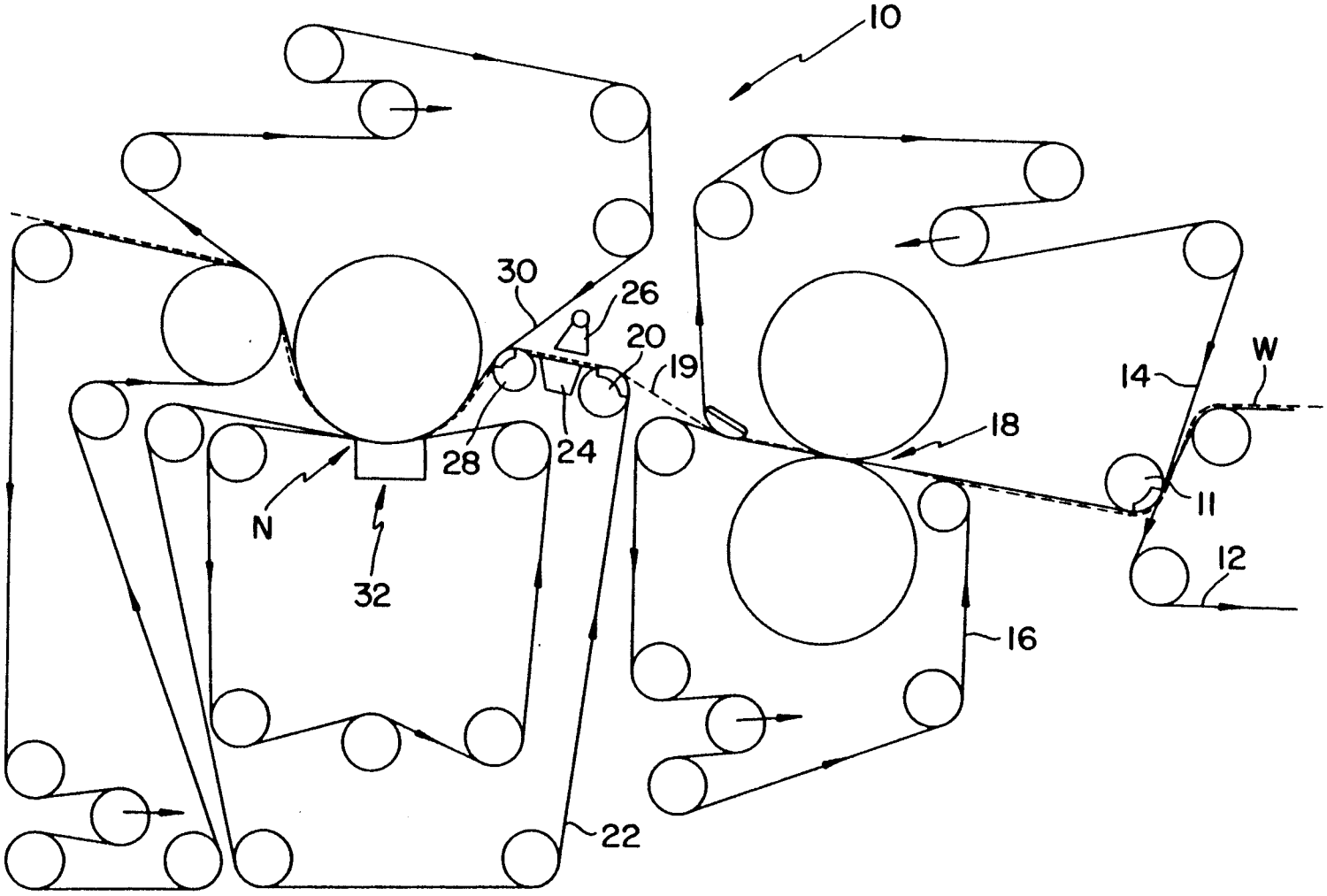
FIG. 1 PRIOR ART
FIG. 1 is a side-elevational view of a prior art suction box associated with two suction rolls.

FIG. 1 is a side-elevational view of a prior art press section, generally designated 10, showing a suction pick-up roll 11 for transferring a web W from a fourdrinier wire 12 to a press felt 14. The web W is sandwiched between a further press felt 16 and the press felt 14 so that the web W is guided through a conventional press couple 18. Thereafter, the web is guided through an open draw 19 and is then drawn by a large diameter suction roll 20 onto a lower felt 22. The web W supported on the lower felt 22 slides over the surface of a suction box 24, the suction box 24 being disposed on the opposite side of the web relative to a steam application means or box 26.

The web W supported on the lower felt 22 is then entrained around a further suction roll 28 which has a smaller diameter relative to the diameter of the suction roll 20.

As the web and lower felt 22 enwrap the further suction roll 28, the web is sandwiched between the lower felt 22 and an upper felt 30.

Thereafter, the web sandwiched between the felts 22 and 30 is guided towards an extended nip N of an extended nip press, generally designated 32.

However, the aforementioned prior art arrangement requires the provision of three relatively costly suction rolls 11,20 and 28.

The present invention avoids the requirement for such suction rolls 11,20 and 28 by the provision of two curved suction box apparatus as described hereinafter.

Figure 2:
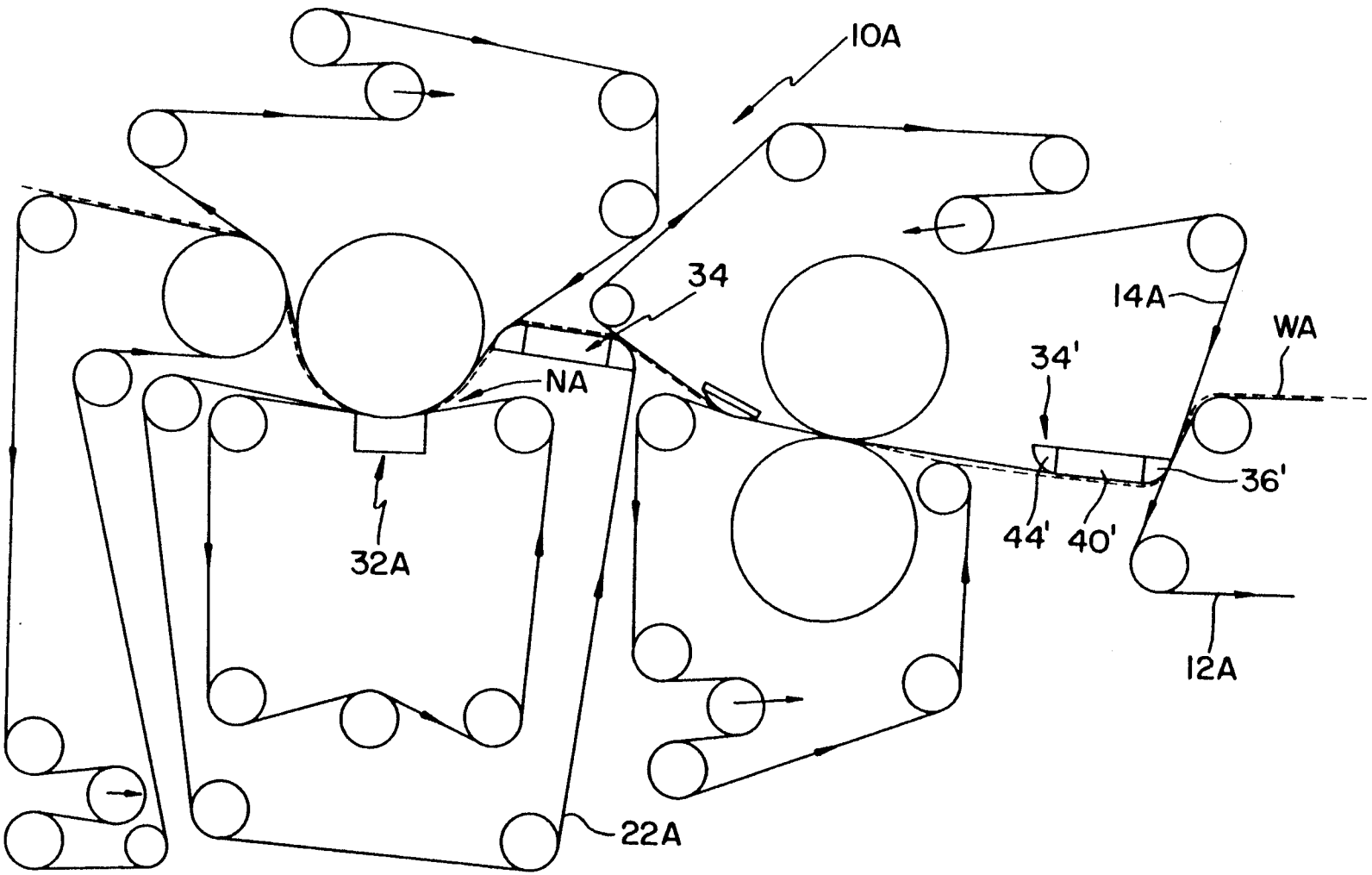
FIG. 2 is a side-elevational view of a curved suction box apparatus according to the present invention showing the disposition of such apparatus within a press section of a papermaking machine.

More particularly, FIG. 2 is a side-elevational view of a press section 10A having a curved suction box apparatus, generally designated 34,34[1] for guiding a web WA towards a nip NA of an extended nip press, generally designated 32A.

Figure 3:
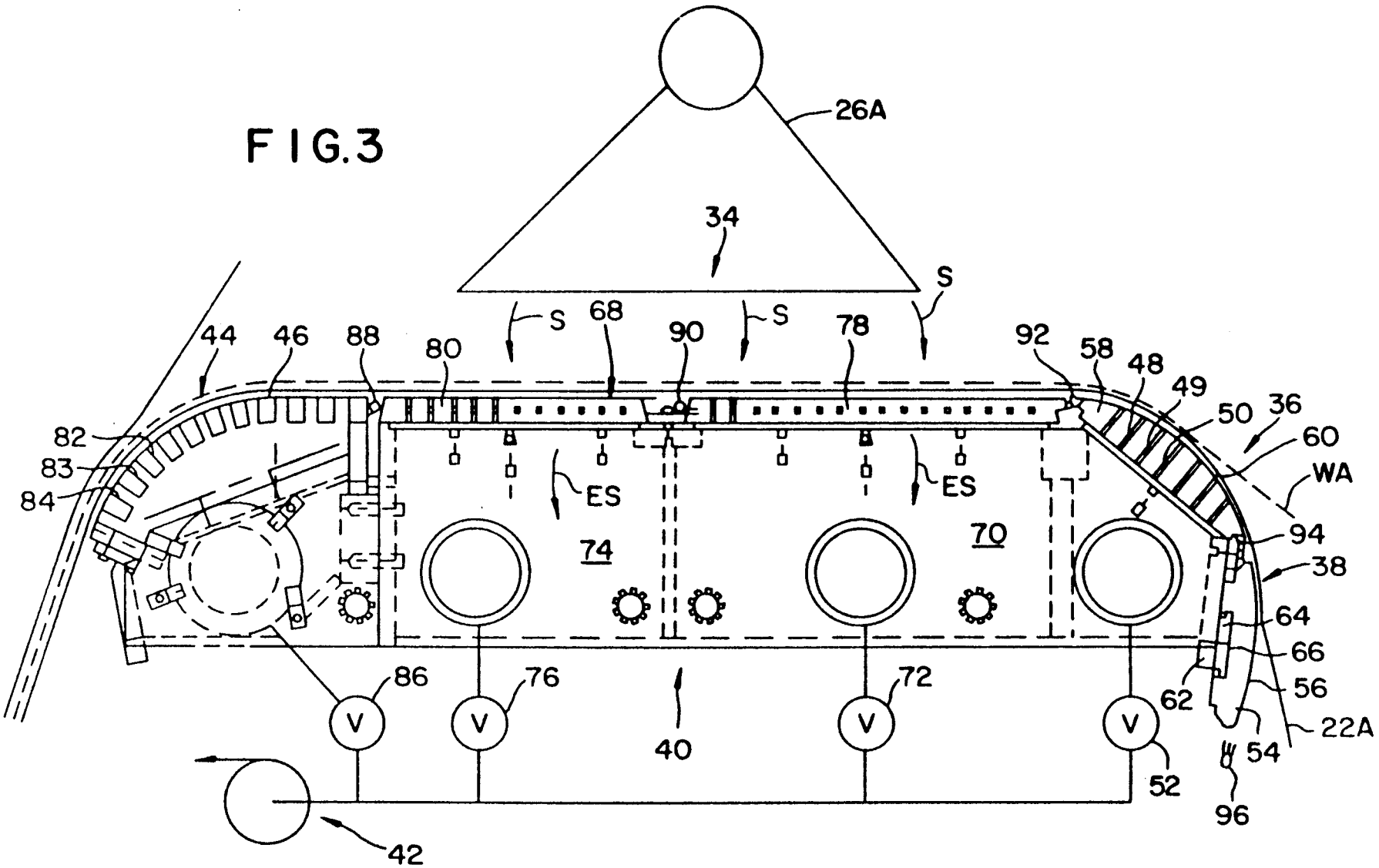
FIG. 3 is an enlarged elevational view of the curved suction box shown in FIG. 2 according to the present invention.

FIG. 3 is an enlarged view of the suction box apparatus 34 shown in FIG. 2. The apparatus 34 includes an initial shoe means, generally designated 36, disposed upstream relative to the nip NA. The shoe means 36 defines a convex surface, generally designated 38, for guiding the web WA.

A box means, generally designated 40, is disposed downstream relative to the initial shoe means 36 for guiding the web WA from the initial shoe means 36. The box means 40 is connected to a partial vacuum means, generally designated 42.

A further shoe means, generally designated 44, is disposed downstream relative to the box means 40. The further shoe means 44 defines a further convex surface 46 for guiding the web WA from the box means 40 towards the nip NA.

In a preferred embodiment of the present invention, the initial shoe means 36 is of ceramic material.

The initial shoe means 36 defines a plurality of perforations 48,49 and 50 which extend from the convex surface 38 to a variable source of partial vacuum 52 such as a valve for controlling the vacuum from the vacuum means 42. The arrangement is such that the web WA guided by the convex surface 38 is drawn towards the convex surface 38.

The initial shoe means 36 includes, more specifically, a solid shoe 54 having an initial curved surface 56 for guiding the web WA or a lower press felt 22A.

A further shoe 58 is disposed downstream relative to the solid shoe 54. The further shoe 58 has a further curved surface 60. The further curved surface 60 defines the plurality of perforations 48 to 50, which extend from the further curved surface 60 to the variable source of partial vacuum 52 such that the web WA is drawn towards the further curved surface 60.

The apparatus 34 also includes a framework 62 which defines a dove-tail shaped extension 64.

The solid shoe 54 defines a cross-machine directional undercut groove 66 which cooperates with the dove-tail shaped extension 64 for removably securing the solid shoe 54 to the framework 62.

The box means 40 includes a perforate surface, generally designated 68, which is connected to the partial vacuum means 42 such that the web WA is drawn towards the perforate surface 68 during movement of the web WA past the perforate surface 68.

More specifically, the box means 40 further includes a first compartment 70 disposed adjacent to the initial shoe means 36. The first compartment 70 is connected to the partial vacuum means 42 via control valve 72 for drawing the web WA towards the perforate surface 68.

A second compartment 74 is disposed downstream relative to the first compartment 70 and is connected to the partial vacuum means 42 via control valve 76 for assisting in drawing the web WA towards the perforate surface 68.

The perforate surface 68 also includes an upstream perforate closure 78 which cooperates with the first compartment 70, and a downstream perforate closure 80 which cooperates with the second compartment 74. The arrangement is such that application of a differential vacuum level to the upstream closure 78 relative to the downstream closure 80 is permitted.

In one embodiment of the present invention, as shown in FIG. 3, the perforate surface 68 is flat.

Figure 4:
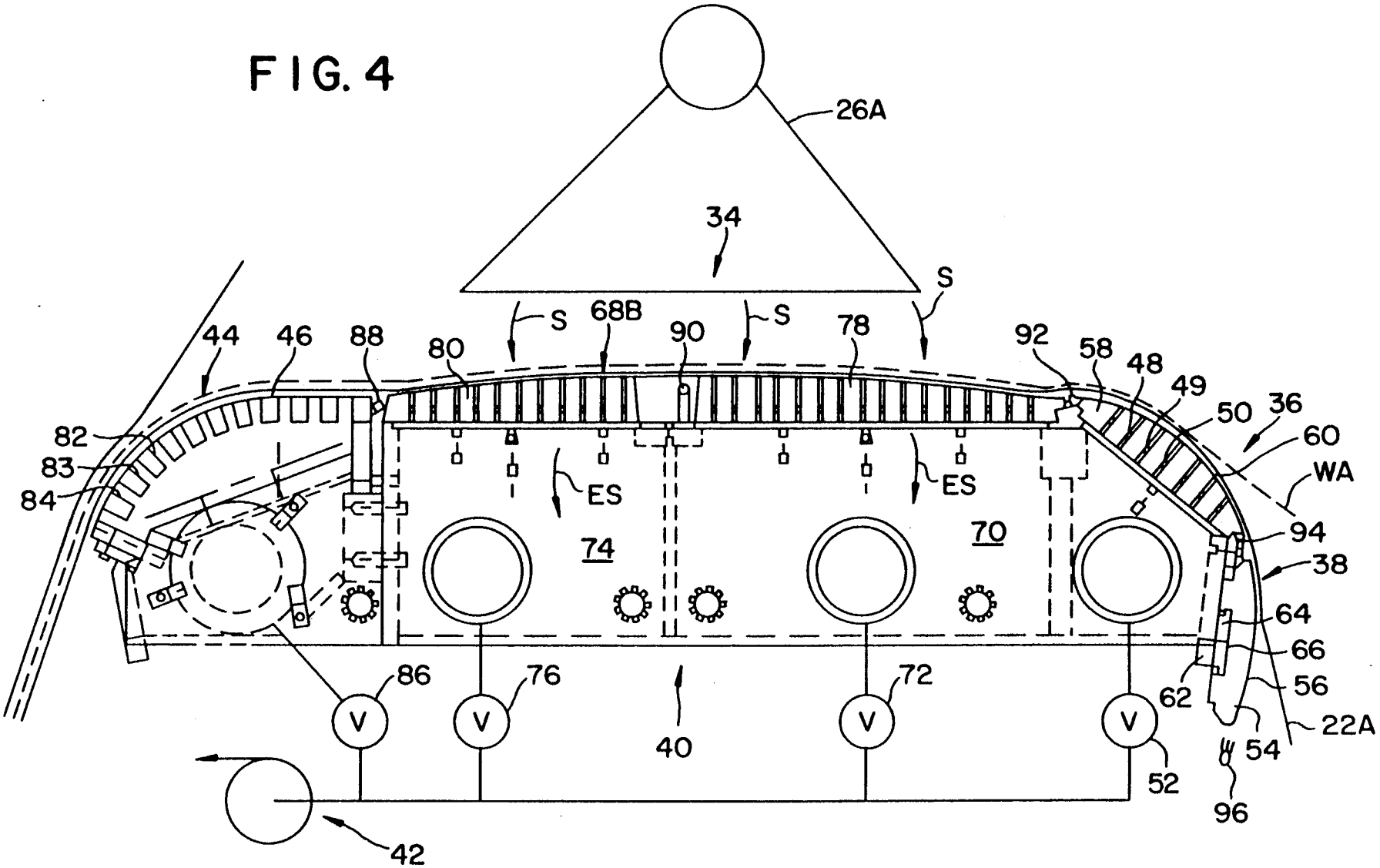
FIG. 4 is a side-elevational view similar to that shown in FIG. 3 but showing an alternative embodiment of the present invention in which the box means defines a curved surface.

In a further embodiment of the present invention, as shown in FIG. 4, the perforate surface 68B is convex. In other respects, the apparatus shown in FIG. 4 is identical with that shown in FIG. 3.

In both embodiments of the present invention, the further shoe means 44 is of ceramic material and defines a plurality of channels 82,83 and 84 which extend from the further convex surface 46 to the partial vacuum means 42 via control valve 86 for guiding the web WA towards the nip NA.

The apparatus shown in FIGS. 3 and 4 also include a first shower 88 for supplying lubricant to the felt 22A between the further shoe means 44 and the box means 40.

A second shower 90 supplies lubricant to the felt 22A between the upstream closure 78 and the downstream closure 80.

A third shower 92 supplies lubricant to the web felt 22A between the box means 40 and the initial shoe means 36.

The apparatus 34 also includes a shower means 94 for supplying lubricant to the felt 22A between the solid shoe 54 and the further shoe 58.

More specifically, the lubricant is water, and the apparatus 34 also includes a flood shower 96 disposed upstream relative to the initial shoe means 36 for continuously supplying water for lubricating and cooling the apparatus 34. The flood shower 96 is disposed between the initial shoe means 36 and the felt 22A.

In a specific application of the subject invention, the apparatus 34 further includes steam application means 26A disposed adjacent to the box means 68 as shown in FIG. 3 or the box means 68B shown in FIG. 4. The arrangement is such that the web WA is disposed between the application means 26A and the box means 68, 68B. The arrangement is such that upon application of steam, as indicated by the arrow S, from the steam applications means 26A to the web WA, such steam S reduces the viscosity of water within the web WA to assist removal of such water during subsequent pressing in the extended nip press 32A. Excess steam, as indicated by the arrow ES, is drawn through the web WA and is extracted through the box means 68 or 68B.

The present invention also includes the suction box apparatus 34[1] shown in FIG. 2 for transferring the web WA from a fourdrinier wire 12A onto a press felt 14A.

The curved suction box apparatus 34[1] is substantially identical to the curved suction box apparatus 34 shown in FIG. 2. Such box apparatus 34[1] overcomes the need of a costly suction pickup roll 11, as used in the prior art proposals.

In operation of the curved suction box apparatus 34[1], the web WA is drawn off of the fourdrinier wire 12A by means of vacuum applied through an initial shoe means generally designated 36[1], a box means 40[1] and a further shoe means 44[1], as in the case of the box apparatus 34.

The curved box arrangement of the present invention is able to be applied to an inverted extended nip press. In such an arrangement, the box serves as both a pick-up and an anti-sheet blowing apparatus. As such, the curved box arrangement according to the present invention is a substitute for the more conventional anti-sheet blowing suction roll configurations.

The aforementioned curved box arrangement according to the present invention has the advantage that it eliminates the cost of two suction rolls and a vacuum and steam box disposed therebetween.

Additionally, the aforementioned arrangement maintains control of the fragile web between the pick-up and the inverted ENP, whereas with conventional suction rolls, it is often necessary to extend one of the press felts into the vicinity of the pick-up roll for double felting of the web, and this may result in at least a six foot felt span.

Also, the arrangement according to the present invention particularly permits control of the web right up to the vicinity of the inverted nip, as the curved box is much thinner than the suction roll counter-part.

The present invention may also be applicable to conventional roll couples, as it permits control of the web almost up to the press nip.

Although in the present invention, as described hereinbefore, steam is applied through the curved box arrangement, the application of steam is not essential to the present invention. One variant of the present invention would include a curved vacuum box where steam may or may not be applied.

When steam is applied to the web, the heat from such steam lowers the surface tension of the fibers, and this assists in subsequent water removal in the press nip. For example, for a temperature increase of 20° F., one percent extra water can be removed during pressing. A temperature to viscosity curve will be non-linear whereas the solids viscosity would be linear.

In a preferred embodiment of the present invention, the curved shoe is connected to a vacuum source, and it is possible to locate the curved box according to the present invention after the press nip immediately downstream relative to the nip.

As stated hereinbefore, the suction box according to the present invention reduces the noise level because in a suction roll arrangement, the holes in the suction roll keep coming round to the same location, thus setting up a particular sound, and such is not the case when using a stationary suction box according to the present invention.

The present invention provides a relatively inexpensive means for transferring a web from a fourdrinier wire onto a press felt of a pressing section, and also provides a suction box means that enables the efficient removal of excess steam from a web prior to pressing such web.

Moreover, the suction box apparatus of the present

Moreover, the suction box apparatus of the present invention, when used for removing steam from a web, overcomes the need for two associated suction rolls and provides a more effective use of the vacuum while reducing operating noise.

I claim:

1. In a papermaking machine press section, a curved pick-up suction box apparatus for guiding a web towards a nip of a nip press, said apparatus comprising:

initial shoe means disposed upstream relative to the nip, said shoe means defining a convex surface for guiding the web;

a box means disposed downstream relative to said initial shoe means for guiding the web from said initial shoe means, said box means being connected to a partial vacuum means;

said initial shoe means including:

a solid shoe having an initial curved surface for guiding the web;

a further shoe disposed downstream relative to said solid shoe, said further shoe having a further curved surface, said further curved surface defining a plurality of perforations which extend from said further curved surface to a variable source of partial vacuum such that the web is drawn towards said further curved surface;

said box means including:

a perforate surface which is connected to a partial vacuum means such that the web is drawn towards said perforate surface during movement of the web past said perforate surface;

a first compartment disposed adjacent to said initial shoe means, said first compartment being connected to a first source of partial vacuum of said partial vacuum means for drawing the web towards said perforate surface;

a second compartment disposed downstream relative to said first compartment, said second compartment being connected to a second source of partial vacuum of said partial vacuum means for assisting in drawing the web towards said perforate surface;

said perforate surface further including:

an upstream perforate closure which cooperates with said first compartment; and a downstream perforate closure which cooperates with said second compartment, the box means being arranged for permitting the application of a differential vacuum level to said upstream closure relative to said downstream closure.

2. A curved suction box apparatus as set forth in claim 1 wherein said initial shoe means is of ceramic material.

3. A curved suction box apparatus as set forth in claim 1 wherein said apparatus further includes:

a framework defining a dove-tail shaped extension;

said solid shoe defining a cross-machine directional undercut groove which cooperates with said dove-tail shaped extension for removably securing said solid shoe to said framework.

4. A curved suction box apparatus as set forth in claim 1 wherein said perforate surface is flat.

5. A curved suction box apparatus as set forth in claim 1 wherein said perforate surface is convex.

6. A curved suction box apparatus as set forth in claim 1 further including:

a further shoe means disposed downstream relative to said box means, said further shoe means defining a further convex surface for guiding the web from said box means towards the nip.

7. A curved suction box apparatus as set forth in claim 6 wherein said further shoe means is of ceramic material.

8. A curved suction box apparatus as set forth in claim 6 wherein said further shoe means defines a plurality of channels which extend from said further convex surface to a partial vacuum source for guiding the web towards the nip.

9. A curved suction box apparatus as set forth in claim 1 wherein said apparatus further includes:

a first shower for supplying lubricant to the web between said further shoe means and said box means;

a second shower for supplying lubricant to the web between said upstream and said downstream closures;

a third shower for supplying lubricant to the web between said box means and said initial shoe means.

10. A curved suction box apparatus as set forth in claim 1 wherein said apparatus further includes:

a shower means for supplying lubricant to the web between said solid shoe and said further shoe, 11. A curved suction box apparatus as set forth in claim 9 wherein said lubricant is water.

12. A curved suction box apparatus as set forth in claim 10 wherein said lubricant is water.

13. A curved suction box apparatus as set forth in claim 1 wherein said apparatus further includes:

a flood shower disposed upstream relative to said initial shoe means for continuously supplying water for lubricating and cooling said apparatus, said flood shower being disposed between said initial shoe means and the web.

14. A curved suction box apparatus as set forth in claim 1 wherein said apparatus further includes:

steam application means disposed adjacent to said box means such that the web is disposed between said application means and said box means so that upon application of steam from said steam application means to the web, such steam reduces the viscosity of water within the web to assist removal of such water during subsequent pressing in the nip press, excess steam being drawn through the web and being extracted through said box means.

* * * * *